United States Patent [19]

Clayton

[11] Patent Number: 4,874,045

[45] Date of Patent: Oct. 17, 1989

[54] STRAIGHT HOLE DRILLING METHOD AND ASSEMBLY

[76] Inventor: Charles H. Clayton, 202 Pecos, Portland, Tex. 78374

[21] Appl. No.: 290,578

[22] Filed: Dec. 27, 1988

[51] Int. Cl.[4] ..... E21B 7/00; E21B 17/22

[52] U.S. Cl. ..... 175/57; 175/323; 175/325

[58] Field of Search ..... 175/320, 323, 325, 57, 175/61, 62, 65

[56] References Cited

U.S. PATENT DOCUMENTS

| | | | |
|---|---|---|---|
| 3,250,578 | 5/1966 | Lubbes . | |
| 3,338,069 | 8/1967 | Ortloff . | |
| 3,419,094 | 12/1968 | Bobo | 175/325 |
| 3,575,247 | 4/1971 | Feenstra | 175/329 |
| 3,784,238 | 1/1974 | Chance et al. | 175/325 X |
| 3,833,077 | 9/1974 | Lavallee | 175/325 |
| 3,916,998 | 11/1975 | Bass, Jr. et al. | 175/325 X |
| 4,285,407 | 8/1981 | Samford | 175/323 |
| 4,403,668 | 9/1983 | Ramsey | 175/325 |
| 4,465,222 | 8/1984 | Hester | 76/108 A X |
| 4,667,751 | 5/1987 | Geczy et al. | 175/61 |
| 4,729,438 | 3/1988 | Walker et al. | 175/76 |
| 4,760,889 | 8/1988 | Dudman | 175/320 |

*Primary Examiner*—Stephen J. Novosad
*Attorney, Agent, or Firm*—G. Turner Moller

[57] ABSTRACT

A drilling assembly comprises a matched bit and stabilizer in which the maximum outer diameter of the bit and stabilizer have been measured and machined to be within predetermined tolerances. The maximum stabilizer diameter is in the range of 0.003–0.025 inches in diameter less than the measured bit O.D. Preferably, the maximum stabilizer diameter is in the range of 0.005–0.010 inches in diameter less than the measured bit O.D. A series of stabilizer assemblies are provided, including a single stabilizer assembly, a double stabilizer assembly, a hole straightening assembly, a large bit O.D. drilling assembly and a small bit O.D. drilling assembly.

20 Claims, 2 Drawing Sheets

STRAIGHT HOLE DRILLING METHOD AND ASSEMBLY

This invention relates to a bottom hole assembly used in drilling a well.

While there are many different types of bottom hole assemblies used in the drilling of a well, the assembly of this invention is used to drill as straight a hole as possible. The hole may be vertical or deviated from the vertical Shortly after rotary drilling first came into widespread use, it was learned that the drilled holes were far from straight —indeed, they meandered substantially. The first lesson learned was to use a string of drill collars, i.e. pipe sections of much heavier wall than drill pipe, immediately above the bit so the weight applied to the bit came from the drill collars rather than much more limber drill pipe. By keeping part of the drill collar string in compression and part in tension, the more limber drill pipe remained entirely in tension. To a large extent, this technique prevents wildly meandering bore holes in most areas of drilling for oil and gas. Indeed, this technique is so successful that the majority of wells drilled in the world use no other technique for drilling relatively straight vertical holes.

There are some areas where this technique is not so successful and additional measures need to be taken to straighten a crooked vertical hole or keep a vertical hole straight. These areas tend to have steeply dipping beds which are alternatingly hard and soft. Typically, when drilling at the interface from a soft formation into a hard formation, the bit tends to meander in an updip direction in an attempt to attack the hard formation in a direction perpendicular to the axis of the hole.

The technique first used to straighten a vertical hole was simply to reduce the amount of weight on the bit. By reducing weight on the bit, the bottom of the drill collar string tends to assume a more vertical direction, which results in a straighter hole. At some later time, specialized bottom hole assemblies were placed at the bottom of the drill collar string, immediately above the bit. These specialized assemblies usually include one or more so-called stabilizers, which are short pipe sections of greater diameter than the drill collar string but smaller than the O.D. of the bit. Stabilizer assemblies are used to drill straight vertical holes, to straighten vertical holes and to drill straight deviated holes. Typical bottom hole assemblies are found in U.S. Pat. Nos. 3,338,069; 3,419,094; 3,575,247; 4,285,407; 4,403,668; and 4,729,438. It is this type assembly that this invention most nearly relates.

A variety of problems exist with standard drilling assemblies, i.e. bits and bottom hole assemblies, and with standard techniques for drilling straight holes and straightening crooked holes. First, it has been learned that all known drilling assemblies allow far too much clearance between the wall of the well bore and the outer diameter of the lands of the stabilizers and thereby allow far too much potential angle deviation from the axis of drilling, whether the axis is vertical or inclined. Second, no known bottom hole assembly optimizes the pipe section between spaced stabilizers. Third, the design of bottom hole assemblies are governed by the specifications or design constraints of the American Petroleum Institute (API). Many engineers or operators refuse to consider equipment, designs or techniques which are not to API specifications. Because the bottom hole assemblies of this invention are outside API specifications, many people will consider the approach unusual, arbitrary or radical. Indeed, knowledgeable people are initially aghast at the tolerances between the maximum outer diameter of the stabilizer and the bore hole and believe, almost devoutly, that the drilling assembly will be easily stuck in the hole.

The drilling assembly of this invention comprises a bit which is matched with one or more stabilizers. The bit to be used in drilling a section of the hole is measured to determine its maximum outer diameter in any suitable fashion, usually with a conventional ring gauge. The outer diameter of the stabilizer or stabilizers to be used with the bit is measured in any suitable manner. If the bit is slightly too large, i.e. greater in diameter than its nominal size, the bit may be ground or otherwise machined to an exact size, plus or minus a thousandth or two. If the bit is slightly smaller than its nominal size, the body of the stabilizer or stabilizers to be used with the bit are ground or otherwise machined to be slightly smaller than the measured diameter of the bit, as opposed to the nominal diameter of the bit. Thus, the stabilizer or stabilizers are matched with the bit to be used so that the stabilizer or stabilizers measure to be 0.003–0.025 inches smaller in diameter than the measured bit diameter. Preferably, the stabilizer or stabilizers measure to be 0.005–0.010 inches smaller in diameter than the measured bit diameter. The difference in diameter between the measured stabilizer diameter and the measured bit diameter determines the maximum possible angle the bit can deviate from the drilling axis. As a general rule, the smaller the difference in diameter, the straighter the hole will be.

The stabilizers of this invention may be configured in a variety of techniques, from simple, short stabilizers having threaded connections at each end to more elaborate assemblies.

One of the building blocks of specialized bottom hole assemblies of this invention is a component comprising a pair of spaced stabilizers separated by a short washoverable, fishable, massive spacer conduit and an upper tubular section that is also fishable. The term fishable means that a conventional overshot can be passed between the exterior of the tubular section and the interior of the hole. The term washoverable means that conventional washpipe can be passed between the exterior of the massive spacer conduit and the interior of the hole. One premise of this invention is that the bottom hole assembly should be as rigid as possible. The massive spacer conduit between the stabilizers has a smaller O.D. than the stabilizer blades, but has a much larger O.D. than the prior art. The combination of the very large stabilizers and the massive spacer conduit creates a very rigid assembly which is effective alone, in multiples or in combination with other assemblies in drilling straight vertical or deviated holes, in straightening crooked holes and the like.

One of the specialized bottom hole assemblies is used to straighten holes which are crooked, usually those which are approaching an agreed predetermined acceptable deviation angle. In this specialized assembly, an ordinary lowermost stabilizer 3/16–¼" undergauge relative to the bit is just above the bit and a spacer joint and one or more second joints are above the lowermost stabilizer. The second joints may be a drill pipe joint or a relatively small drill collar joint. The component of this invention, comprising oversized stabilizers and oversized spacer conduit are connected to the second joint. By running weight on the bit equal to or less than the buoyant weight of the spacer joint and second joints, the lower end of the assembly acts as a pendulum and is effective to straighten crooked holes.

In another specialized assembly of this invention, used in relatively small diameter holes, i.e. smaller than 6¾", a pair of the components of this invention are connected together immediately above the drill bit. A massive spacer joint is connected to the uppermost component and another stabilizer is positioned above the spacer joint.

It is an object of this invention to provide an improved method and apparatus for drilling a bore hole in the earth.

Another object of this invention is to provide an improved drilling assembly including a bit and a bottom hole assembly.

A further object of this invention is to provide an improved drilling assembly in which the bit is matched with a stabilizer.

These and other objects of this invention will become more fully apparent as this description proceeds, reference being made to the accompanying drawings and appended claims.

IN THE DRAWINGS

Figure 1:
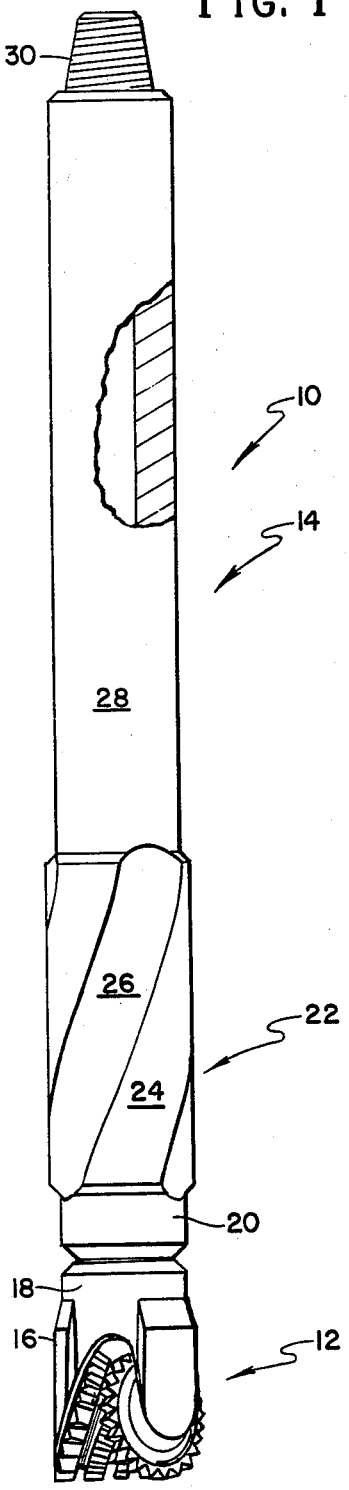
FIG. 1 is a view, partly in cross-section, of a bottom hole assembly in accordance with this invention.

Referring to FIG. 1, there is illustrated a drilling assembly 10 of this invention comprising, as major components, a bit 12 and a bottom hole assembly 14. The bit 12 may be a cone-roller bearing type, a conventional diamond bit or a polycrystalline insert type and includes a bit body 16 of predetermined diameter, a shank 18 and an upper threaded end received in an internally threaded box 20 of the bottom hole assembly 14. The bottom hole assembly 14 includes a stabilizer 22 above the box 20 having a series of lands 24 and flutes 26 and a fishing neck 28 having an upwardly facing pin 30 thereon.

To match the bit 12 and bottom hole assembly 14, the bit which is going to be used to drill the hole is obtained and the maximum outer diameter thereof is measured in any suitable fashion, as by the use of a conventional ring gauge. Bits are not precisely made instruments in the sense that the outer diameter thereof is not exactly the same as the nominal diameter as shown in Table I:

TABLE I

| API Tolerances for New Bits | | | |
|---|---|---|---|
| ROLLER CUTTER BITS | | DIAMOND BITS | |
| Nominal Bit Size | API Tolerance | Nominal Bit Size | API Tolerance |
| 5⅝–13¾" | +1/32" minus 0 | <6¾" | +0 minus .015" |
| 14–17½" | +1/16" minus 0 | 6 25/32–9" | +0 minus .020" |
| 17⅞–26" | +3/32" minus 0 | 9 1/32–13¾" | +0 minus .030" |

TABLE I-continued

| API Tolerances for New Bits | | | |
|---|---|---|---|
| ROLLER CUTTER BITS | | DIAMOND BITS | |
| Nominal Bit Size | API Tolerance | Nominal Bit Size | API Tolerance |
| | | 13 25/32"+ | +0 minus .045" |
| | | >17 17/32" | +0 minus .063" |

If the measured bit diameter is larger than the nominal size, which is usually the case with roller cutter bits, the oversize component is usually hardfacing material which has been applied to the shank of the bit and/or to the edge of the bearing case. An oversize bit is placed in any suitable machining device such as a grinder and material is removed from the outer diameter until the O.D. of the bit is a predetermined diameter, usually but necessarily the nominal diameter, 0.003–0.025 inches greater than the measured outer diameter of the lands 24 of the bottom hole assembly 14 which is going to be used with the bit.

If the bit is smaller than nominal size, which is usually the case with diamond and polycrystalline bits, the bottom hole assembly 14 is placed in a grinder and the hardsurfacing material on the lands 24 ground down to a predetermined diameter less than the measured diameter of the bit.

Because of wear that occurs on the stabilizer lands 24, it is often necessary to build up the outer diameter of the lands with hardsurfacing material, which may be accomplished in any suitable fashion. In such situations, it is often necessary to machine both the bit and the stabilizer which are to be used together to obtain the desired tolerances between them.

Because of the large allowable tolerances in bit diameter, it is necessary to match the bit and the stabilizer if the maximum diameter of the stabilizer is selected to be very close to the maximum diameter of the bit. If the bit is more than about 0.025 inches in diameter larger than the stabilizers, the drilled hole tends to deviate like conventionally drilled holes do. At closer tolerances between the stabilizer and bit, more care and judgment needs to be taken. In very competent rocks which are not subject to swelling, such as clean limestones, the bit and stabilizer may be very close together. If the bit is less than about 0.003 inches in diameter larger than the stabilizers, there is an inordinate danger of getting stuck.

Figure 2:
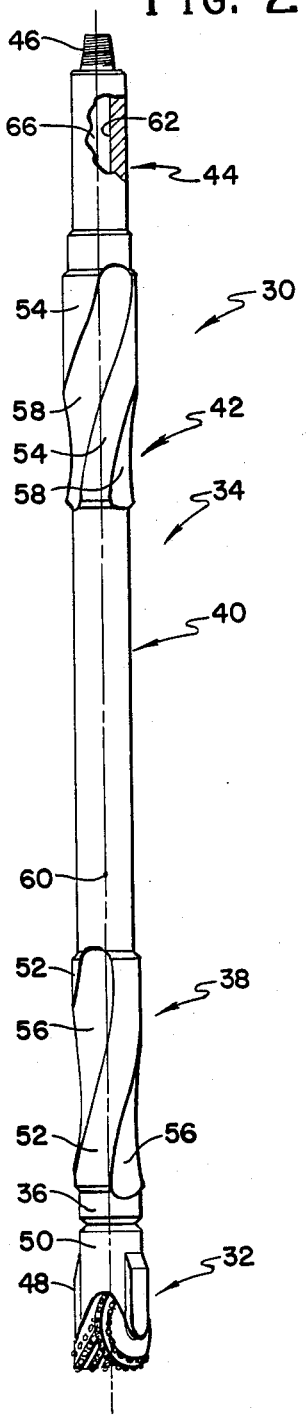
FIG. 2 is a view, partly in cross-section, of a bottom hole assembly used by itself, in pairs, or in other combinations to drill straight holes, to drill deviated holes or to straighten crooked holes.

Referring to FIG. 2, there is illustrated a drilling assembly 30 of this invention comprising, as major components, a bit 32 and a bottom hole assembly 34 comprising a box 36, a lower stabilizer 38, a spacer conduit 40, an upper stabilizer 42, a fishing neck 44 and an upwardly facing pin 46.

One of the peculiarities of this invention is that the lower stabilizer 38 is designed in such a way that the bit 32, which is of the short shank type, is coupled to the bottom hole assembly 34 only a few inches below the bottom of the lowermost stabilizer 38. The bit 32 may be of the cone-roller bearing type, the polycrystalline insert type or the conventional diamond type and includes a bit body 48 of predetermined diameter, a shank 50 and an upper threaded end received in the internally threaded box 36 of the lowermost stabilizer 38. The box 36, below the lands 52 of the lowermost stabilizer 38, is not more than about 3–4" long to position the bit 32 as close as possible to the bottom of the stabilizer 38.

The configuration of the stabilizers 38, 42 is more-or-less conventional including three lands 52, 54 separated by three flutes 56, 58. The lands 52, 54 and consequently the flutes 56, 58 are slightly curved about the axis 60 of the assembly 30 for an arc of 120°. The diameter of the lands 52, 54 are machined to be $\frac{1}{8}$–$\frac{1}{2}$" less than the diameter of the bit 32. Hardsurfacing material is then applied, in any suitable manner, to the lands 52, 54. The flutes 56, 58 are made by cutting metal away from the cylindrical body from which the stabilizers 38, 42 are made. The minimum diameter of the flutes 56, 58, i.e. in the center or bottom, are slightly less, i.e. about $\frac{1}{2}$" less, than the outer diameter of the sections immediately above and below the stabilizers 38, 42.

The spacer conduit 40 is, in accordance with this invention, as massive and as rigid as possible. Thus, the outer diameter is made as large as possible while being washoverable, i.e. retaining the capability of being washed over with conventionally available wash pipe. Thus, with a bit of $6\frac{1}{2}$–$6\frac{3}{4}$" OD, the spacer conduit 14 is $5\frac{1}{2}$" OD. The reason the spacer conduit 40 is no larger with this size bit is that there is no washpipe that can wash over the OD without having to mill away part of the conduit body. The obvious technique to make a stiff bottom hole assembly for use with this size bit is to comply with available rental tool availability and the standards of the American Petroleum Institute (API) which means that the spacer conduit is normally $4\frac{3}{4}$" OD. This means the spacer conduit is washoverable and fishable, as contrasted to this invention wherein the spacer conduit 40 for this size bit is washoverable but not fishable with an overshot should a separation occur at the base of the land 54.

In order to make the spacer conduit 40 as massive as possible, the internal diameter of the passage is as small as possible, commensurate with the ability to deliver adequate quantities of drilling mud at pressure losses which might be thought excessive, at least in larger sized holes. At small diameter assemblies, the internal diameter of the passage 62 tends to be the same as API standards. As the diameter of the assemblies 10 increases, the internal diameter of the passage 62 increases, but not as fast as API standards.

The length of the spacer conduit 40 is short by comparison to common drilling practice and available rental tools. It is preferably about three feet long for all OD sizes. Thus, the bottom hole assemblies 34 of this invention tend to be the same length regardless of diameter. This is in contrast to common practice or International Association of Drilling Contractors (IADC) standard bottom hole assemblies which tend to be much longer in larger diameter sizes.

The fishing neck 44 is connected to the upper stabilizer 42 and is as massive as possible commensurate with being receivable inside an overshot which can be run inside a hole the same size as the bit. Thus, the fishing neck 44 of this invention tends to have significantly larger OD's than API standard fishing necks.

One of the peculiarities of the bottom hole assembly 34 is that it is preferably made of a single piece of material. Thus, it is free of threaded connections from below the externally threaded pin 46 to above the internally threaded box 36. One purpose is to make the assembly 34 as rigid as possible. Another reason is that the absence of threaded joints in the assembly 34 reduces the things that can go wrong, such as washouts in a tool joint, twist offs and the like because the assembly 34 is not easily retrieved from a hole if it ever becomes stuck.

If one were to make a family of bottom hole assemblies having the same organization as the assembly 34, but complying with API standards, the assemblies would have basically the same stabilizers, but the length and diameter of the spacer conduits and fishing necks would be significantly different, as shown in Table II.

TABLE II

Comparison of this invention to the most massive BHA by API standards

| | Bit Sizes | | | | | | | | | | | |
|---|---|---|---|---|---|---|---|---|---|---|---|---|
| | 5⅞" to 6¼" | Same size API | 6⅜" to 6¾" | Same size API | 8⅜" to 8¾" | Same size API | 9¾" to 9⅞" | Same size API | 10⅝" to 11" | Same size API | 11¾" to 12¼" | Same size API |
| fishing neck OD | 5" | 4⅛" | 5" | 4¾" | 7" | 6½" | 8⅜" | 8" | 8⅜" | 8" | 10" | 9" |
| length of fishing neck | 28" | | 24" | | 28" | | 25" | | 25" | | 24" | |
| OD of upper stabilizer crown | 5¾" | 5¾" | 6¼" | 6¼" | 8¼" | 8¼" | 9½" | 9½" | 10⅜" | 10⅜" | 11½" | 11½" |
| length of upper stab. crown | | | | 16" | | | | | | 18" | | |
| OD of spacer conduit | 5" | 4⅛" | 5½" | 4¾" | 7" | 6½" | 8⅜" | 8" | 8⅜" | 8" | 10" | 9" |
| length of spacer conduit | 36" | 48" | 36" | 72" | 36" | 96" | 36" | 8–10' | 36" | 8–10' | 36" | 8–10' |
| OD of lower stabilizer crown | 5¾" | 5¾" | 6¼" | 6¼" | 8¼" | 8¼" | 9½" | 9½" | 10⅜" | 10⅜" | 11½" | 11½" |
| length of lower stab. crown | 18" | 12–14" | 18" | 12–14" | 18" | 12–14" | 18" | 12–14" | 18" | 12–14" | 18" | 14–16" |
| overall length | 8'5" | variable | 8'5" | variable | 8'5" | variable | 8'5" | variable | 8'5" | variable | 8'5" | variable |
| inside diameter | 1½" | 1¼" | 1½" | 1½" | 2" | 2¼" | 2" | 2⅜" | 2" | 2¾" | 2" | 2¾" |
| tool joint connection, APIReg | 3½" | 2⅞" | 3½" | 3½" | 4½" | 4½" | 6⅝" | 6⅝" | 6⅝" | 6⅝" | 6⅝" | 6⅝" |
| OD of spacer joint | 5" | 4⅛" | 5½" | 4¾" | 7" | 6½" | 8⅜" | 8" | 8⅜" | 8" | 10" | 9" |
| length of spacer joint | 13.5–14' | 72" | 13.5–14' | 72" | 13.5–14' | 72" | 13.5–14' | 8–10' | 13.5–14' | 8–10' | 13.5–14' | 8–10' |

As in the embodiment of FIG. 2, the exact maximum diameter of the lands 52, 54 depends on the measured diameter of the bit 32. Thus, the dimensions shown in Table II relate to the diameter of the lands 52, 54 before the application of hardsurfacing material thereon. Because of the large allowable tolerances in bit diameter, it is necessary to match the bit and the stabilizer when using tolerances in accordance with this invention. The outer surface of the bit, at the maximum diameter, and/or the outer surface of the stabilizer, at the maximum diameter, are accordingly machined to produce a drilling assembly 30 in which the maximum stabilizer 0.D. is in the range of 0.003–0.025 inches less than the maximum diameter of the bit 32. Preferably, the maximum stabilizer 0.D. is in the range of 0.005–0.010 inches less than the maximum diameter of the bit to make the potential deviation of the drilled hole from the drilling axis 60 even smaller. This means that the drilled hole will only be 0.003–0.025 inches larger than the maximum stabilizer O.D. Such tolerances will be surprising to those skilled in the art.

Although the bottom hole assembly 34 can be used alone in the drilling of wells to straighten a crooked hole or to deviate a hole, it often occurs that the assemblies 34 are used in pairs or combinations for particular purposes. Usually, wells are drilled without taking substantial measures to insure that the hole is straight. The reason is that, in most areas, with the normal number of drill collars, the normal weight applied to the bit and normal rotary speeds, the resultant hole is normally within accepted tolerances. When periodic inclination measurements show the hole is beginning to deviate significantly, drillers use the tried and true methods of straightening the hole, usually by reducing the amount of weight applied to the bit and perhaps increasing rotary speed. If the hole continues to deviate and approaches predetermined inclination limits, specialists are called to straighten the hole.

Figure 3:
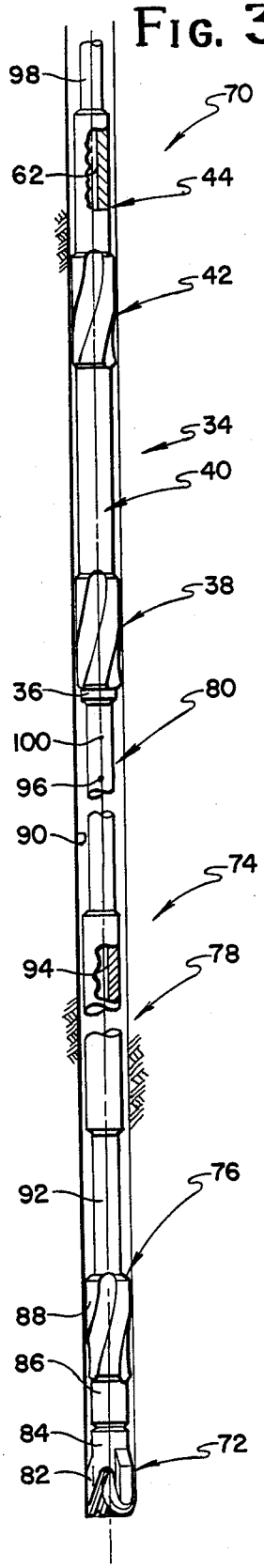
FIG. 3 is a view, partly in cross-section, of a well drilling assembly used to straighten crooked holes.

As shown in FIG. 3, a well drilling assembly 70 known as a straightening assembly comprises, as major components, a bit 72 and a bottom hole assembly 74 including a first or lowermost stabilizer 76, a pony collar or spacer joint 78, a heavy drill pipe joint or thin drill collar 80 and an assembly 34. In some conditions, a second assembly 34 is connected above the illustrated assembly 34.

The bit 72 may be of the cone-roller bearing type, the polycrystalline insert type or diamond type and includes a bit body 82 of predetermined measured diameter, a shank 84 having an upper threaded end received in an internally threaded box 86 of the stabilizer 76. The box 86, below the lands 88 of the first stabilizer 76, is substantially longer than the comparable box 36 in the bottom hole assembly 34. The purpose is to make the assembly of FIG. 2 as stiff as possible. Such stiffness is not needed in the straightening assembly 70 of FIG. 3 because the bottom part of the assembly 70 is allowed some freedom of movement to straighten the hole.

The stabilizer 76 may be of a conventional type and is slightly smaller than the diameter of the hole 90 or the OD of the bit 72. Preferably, the OD of the stabilizer 76 is at least 3/16–$\frac{1}{4}$" less than the bit OD and the stabilizer 76 is smaller than the stabilizers 38, 42 allowing the lowermost stabilizer 76 some freedom of movement. The stabilizer 76 includes a neck 92 that is about the same length as the spacer conduit 40 but is smaller in diameter and thus more limber.

The spacer joint or pony collar 78 is preferably the same diameter as the spacer conduit 40 of the assembly 34, is on the order of 13–14 feet long and has a passage 94 the same internal diameter as the passage 62. The spacer joint 78 has a predetermined weight in drilling mud of the density employed in the well. The weight applied to the bit 72 in the straightening operation will be the buoyed weight of the spacer joint 78 or nearly so.

The heavy weight drill pipe or thin drill collar section 80 is present to allow the lower end of the straightening assembly 70 to deflect relative to the assembly 34. Thus, the section 80 is considerably more flexible than the spacer joint 40 of the assembly 34. The neutral point 96 of the assembly 70, which separates that part of the string in compression from that part of the string in tension, preferably resides in the section 80. The upper end of the section 80 threadably connects to the bottom hole assembly 34.

In straightening a hole, the weight applied to the bit 72 is the buoyed weight of the stabilizer 76, the spacer joint 78 and part of the section 80, usually no more than half so the neutral point 96 stays within the limits of the section 80. The bottom hole assembly 34 and the drill string 98, usually comprising a length of drill collars and/or drill pipe, remain in tension. With the assembly 34 in tension, the lower part of the straightening assembly 70 acts as a pendulum to seek a more nearly vertical orientation during drilling. This causes the hole to straighten. In one situation, the drilling contractor on a turn key job in Duval County, Tex. was approaching the maximum allowable 5° deviation at 15,307'. A hole straightening assembly 70 of this invention was run into the well and drilling continued. At the end of 58 hours drilling and 219 feet, the hole had straightened to a $3\frac{3}{4}$° deviation at 15,589 feet. Thus, hole straightening occurred while drilling at 3.8 feet/hour. This particular situation is very impressive because normal drilling in this area at this depth, using much more bit weight, usually achieves penetration rates of 2.4 to 4.9 feet/hour.

As in the embodiment of FIGS. 1 and 2, the exact maximum diameter of the stabilizers 38, 42 depends on the measured diameter of the bit 72. Because of the large allowable tolerances in bit diameter, it is necessary to match the bit and the stabilizer when using tolerances in accordance with this invention. The outer surface of the bit 72, at the maximum diameter thereof, and/or the outer surface of the stabilizers 38, 42, at the maximum diameter thereof, are accordingly machined to produce a drilling assembly 70 in which the maximum stabilizer O.D. is in the range of 0.003–0.025 inches less than the maximum diameter of the bit 72. Preferably, the maximum stabilizer O.D. is in the range of 0.005–0.010 inches less than the maximum diameter of the bit to make the potential deviation of the drilled hole from the drilling axis 100 even smaller. This means that the drilled hole will only be 0.003–0.025 inches larger than the maximum stabilizer O.D. Such tolerances will be surprising to those skilled in the art.

Figure 4:
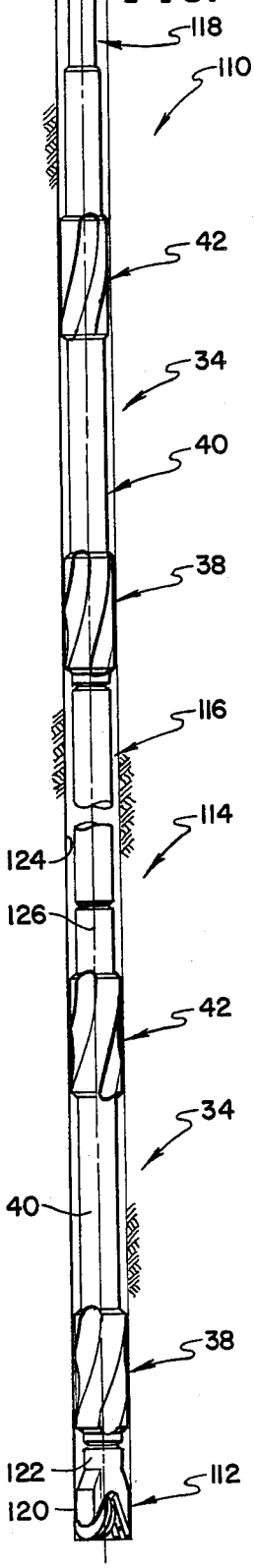
FIG. 4 is a view, partly in cross-section, of a well drilling assembly used to drill straight holes greater than a predetermined size

Referring to FIG. 4, there is illustrated a drilling assembly 110 comprising a bit 112 and a bottom hole assembly 114 including a first or lowermost assembly 34, a pony collar or spacer joint 116, a second or uppermost assembly 34 and a drill string 118 connected to the uppermost assembly 34.

The bit 112 may be of the cone-roller bearing type, the polycrystalline insert type or the diamond type and includes a bit body 120 of predetermined diameter, a shank 122 having an upper threaded end received in the internally threaded box of the lower assembly 34.

The spacer joint 116 is preferably the same diameter as the spacer conduit 40 of the assembly 34, is on the order of 13–14 feet long and has the same internal diameter as the spacer conduit 40 of the assembly 34. The purpose of the spacer joint 116 is not merely to provide weight as in the embodiment of FIG. 3. The spacer joint 116 separates the lower and upper assemblies 34 to allow the stabilizing influence of the stabilizers 36, 42 to work over an extended length of the bore hole 124.

As in the embodiment of FIGS. 1–3, the exact maximum diameter of the stabilizers 36, 42 depends on the measured diameter of the bit 112. Because of the large allowable tolerances in bit diameter, it is necessary to match the bit and the stabilizer when using tolerances in accordance with this invention. The outer surface of the bit 112, at the maximum diameter thereof, and/or the outer surface of the stabilizers 36, 42, at the maximum diameter thereof, are accordingly machined to produce a drilling assembly 110 in which the maximum stabilizer O.D. is in the range of 0.003–0.025 inches less than the maximum diameter of the bit 112. Preferably, the maximum stabilizer O.D. is in the range of 0.005–0.010 inches less than the maximum diameter of the bit to make the potential deviation of the drilled hole from the drilling axis 126 even smaller. This means that the drilled hole will only be 0.003–0.025 inches larger than the maximum stabilizer O.D. Such tolerances will be surprising to those skilled in the art.

In use with large diameter bits, i.e. greater than $6\frac{3}{4}''$ O.D., the drilling assembly 110 worked extremely well and did not suffer excessive wear. In use with small diameter bits, i.e. less than $6\frac{3}{4}''$ O.D., the stabilizer 42 of the lower assembly 34 showed excessive wear. The conclusion is that the lateral forces applied to this stabilizer were greater than could be accommodated, almost surely because stabilizers of this size had insufficient surface area engaging the bore hole wall.

Figure 5:
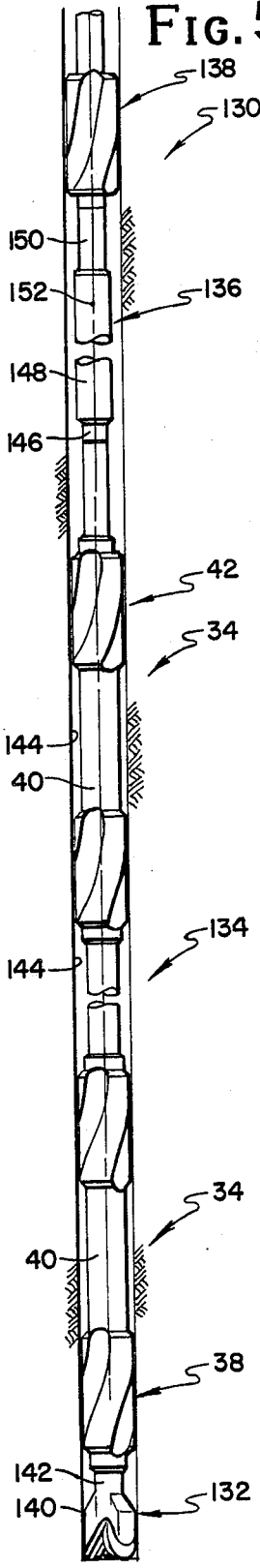
FIG. 5 is a view, partly in cross-section, of a well drilling assembly used to drill straight holes smaller than a predetermined size.

To overcome this problem, the drilling assembly 130 of FIG. 5 is designed for use with small 0.D. bits, i.e. those less than $6\frac{3}{4}''$ O.D. Th drilling assembly 130 comprises, as major components, a bit 132 and a bottom hole assembly 134. The bottom hole assembly 134 includes first and second assemblies 34, a pony collar or spacer joint 136 and an assembly 138 above the joint 136.

The bit 132 may be of the cone-roller bearing type, the polycrystalline insert type or the diamond type and includes a bit body 140 of predetermined diameter, a shank 142 having an upper threaded end received in the internally threaded box of the lowermost assembly 34. The lowermost assembly 34 is threadably connected to the next successive assembly 34 which connects to the spacer joint 136.

The spacer joint 136 is preferably the same diameter as the spacer conduit 40 of the assemblies 34, is on the order of 13–14 feet long and has the same internal diameter as the spacer conduit 40 of the assembly 34. The purpose of the spacer joint 136 is not merely to provide weight as in the embodiment of FIG. 3. The spacer joint 136 separates the two lower assemblies 34 from the uppermost assembly 138 to allow the stabilizing influence of the stabilizers 36, 42 to work over an extended length of the bore hole 144. The spacer joint 136 preferably includes a box 146 receiving the pin of the second assembly 34, a massive central section 148 and a fishing neck 150 having a pin received in the uppermost assembly 138 which may comprise the assembly 14 of FIG. 1 or the assembly 34 of FIG. 2.

As in the embodiment of FIGS. 1–4, the exact maximum diameter of the stabilizers 36, 42 depends on the measured diameter of the bit 132. Because of the large allowable tolerances in bit diameter, it is necessary to match the bit and the stabilizer when using tolerances in accordance with this invention. The outer surface of the bit 132, at the maximum diameter thereof, and/or the outer surface of the stabilizers 36, 42, at the maximum diameter thereof, are accordingly machined to produce a drilling assembly 130 in which the maximum stabilizer O.D. is in the range of 0.003–0.025 inches less than the maximum diameter of the bit 132. Preferably, the maximum stabilizer O.D. is in the range of 0.005–0.010 inches less than the maximum diameter of the bit to make the potential deviation of the drilled hole from the drilling axis 152 even smaller. This means that the drilled hole will only be 0.003–0.025 inches larger than the maximum stabilizer O.D. Such tolerances will be surprising to those skilled in the art.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of drilling a well comprising
matching a particular bit with a particular stabilizer including
measuring a first maximum outer diameter of a bit;
selecting a stabilizer having a maximum outer diameter; and
machining the bit and removing material from the outer surface thereof to a second maximum diameter less than the first diameter and greater than the maximum outer diameter of the stabilizer.

2. The method of claim 1 further comprising
connecting the bit and the stabilizer in an assembly; and
drilling a hole in the earth with the assembly.

3. The method of claim 2 wherein the maximum outer diameter of the stabilizer is in the range of 0.003–0.025 inches less than the second maximum bit diameter.

4. The method of claim 2 wherein the maximum outer diameter of the stabilizer is in the range of 0.005–0.010 inches less than the second maximum bit diameter.

5. A method of drilling a well comprising
drilling a bore hole in the earth to a depth and determining the angle of departure of the bore hole relative to a vertical axis;
reducing the angle of departure of the bore hole relative to the vertical axis including
matching a particular bit with a particular stabilizer including
measuring a maximum outer diameter of a bit;
selecting a stabilizer having an outer surface providing a first maximum outer diameter; and
machining the stabilizer and removing material from the outer surface thereof to a second maximum diameter less than the first diameter and less than the maximum outer diameter of the bit; and drilling a continuation of the bore hole with the matched bit and stabilizer.

6. The method of claim 5 wherein the second maximum outer diameter of the stabilizer is in the range of 0.003–0.025 inches less than the maximum bit diameter.

7. The method of claim 5 wherein the second maximum outer diameter of the stabilizer is in the range of 0.005–0.010 inches less than the maximum bit diameter.

8. A well drilling assembly comprising a bit having a passage therethrough, predetermined outer diameter to drill a hole of the predetermined size and an upper end;

a bottom hole assembly having a passage therethrough communicating with the bit passage and including a lower stabilizer having a lower end coupled to the bit upper end, a crown having an outer diameter 0.003–0.025 inches smaller than the bit diameter and a plurality of flutes, and an upper end;

a washoverable spacer conduit having an outer diameter $\frac{7}{8}$–$\frac{1}{4}$" smaller than the bit diameter connected to the upper end of the lower stabilizer;

an upper stabilizer having a lower end connected to the conduit, a crown having an outer diameter 0.003–0.025 inches smaller than the bit diameter and a plurality of inclined flutes and an upper end; and a fishable neck connected to the upper end of the upper stabilizer.

9. The well drilling assembly of claim 8 wherein the fishing neck has an outer diameter the same as the spacer conduit.

10. The well drilling assembly of claim 8 wherein the fishing neck has an outer diameter smaller than the spacer conduit.

11. The well drilling assembly of claim 8 wherein the stabilizer crown comprises a generally cylindrical exterior and the flutes comprise passages opening through the cylindrical exterior having an internal diameter and an external diameter the same as the crown, the flute internal diameter being smaller than the outer diameter of the spacer conduit.

12. The well drilling assembly of claim 8 wherein the bit diameter is $5\frac{7}{8}$–$6\frac{3}{4}$" diameter and the passage through the bottom hole assembly has an internal diameter of $1\frac{1}{2}$".

13. The well drilling assembly of claim 8 wherein the bit diameter is $8\frac{3}{8}$–$12\frac{1}{4}$" diameter and the passage through the bottom hole assembly has an internal diameter of 2".

14. The well drilling assembly of claim 8 wherein the stabilizers are 0.005–0.010 inches smaller in diameter than the bit diameter.

15. A well drilling assembly for straightening crooked holes, comprising a bit having a passage therethrough, a predetermined outer diameter to drill a hole of the predetermined size and an upper end;

a bottom hole assembly having a passage therethrough communicating with the bit passage and including a lower stabilizer having a lower end coupled to the bit, a crown having an outer diameter 0.003–0.025 inches smaller than the bit diameter and a plurality of flutes, and an upper end;

a spacer joint having an outer diameter 7/8–$1\frac{1}{4}$" smaller than the bit diameter, a lower end connected to the upper end of the lower stabilizer and an upper end;

a pipe section having a lower end connected to the upper end of the spacer joint and an upper end, the spacer joint and pipe section being at least 30' long;

a second stabilizer having a lower end coupled to the pipe section upper end, a crown having an outer diameter larger than the outer diameter of the lowermost stabilizer and being 0.003–0.025 inches smaller than the bit diameter and a plurality of flutes, and an upper end;

a spacer conduit having an outer diameter $\frac{7}{8}$–$1\frac{1}{4}$" smaller than the bit diameter, a lower end connected to the upper end of the lower stabilizer;

an upper stabilizer having a lower end connected to the conduit, a crown having an outer diameter larger than the outer diameter of the lowermost stabilizer and being 0.003–0.025 inches smaller than the bit diameter and a plurality of flutes and an upper end; and a fishing neck connected to the upper end of the upper stabilizer.

16. The well drilling assembly of claim 15 wherein the stabilizers are 0.005–0.010 inches smaller in diameter than the bit diameter.

17. A well drilling assembly comprising a bit having a passage therethrough, a predetermined outer diameter greater than $6\frac{3}{4}$" to drill a hole of the predetermined size greater than $6\frac{3}{4}$" diameter and an upper end;

a bottom hole assembly having a passage therethrough communicating with the bit passage and including a first lowermost stabilizer having a lower end coupled to the bit upper end, a crown having an outer diameter 0.003–0.025 inches smaller than the bit diameter and a plurality of flutes, and an upper end;

a first spacer conduit having an outer diameter $\frac{7}{8}$–$1\frac{1}{4}$" smaller than the bit diameter connected to the upper end of the lower stabilizer;

a second stabilizer having a lower end connected to the conduit, a crown having an outer diameter 0.003–0.025 inches smaller than the bit diameter and a plurality of inclined flutes and an upper end;

a fishing neck connected to the upper end of the upper stabilizer;

a spacer joint having an outer diameter $\frac{7}{8}$–$1\frac{1}{4}$" smaller than the bit diameter, a lower end connected to the upper end of the second stabilizer and an upper end;

a third stabilizer having a lower end coupled to the spacer joint upper end, a crown having an outer diameter $\frac{1}{8}$–$\frac{1}{2}$" smaller than the bit diameter and a plurality of inclined flutes, and an upper end;

a second spacer conduit having an outer diameter $\frac{7}{8}$–$1\frac{1}{4}$" smaller than the bit diameter connected to the upper end of the third stabilizer;

a fourth stabilizer having a lower end connected to the conduit, a crown having an outer diameter $\frac{1}{8}$–$\frac{1}{2}$" smaller than the bit diameter and a plurality of inclined flutes and an upper end; and a fishing neck connected to the upper end of the fourth stabilizer.

18. The well drilling assembly of claim 17 wherein the stabilizers are 0.005–0.010 inches smaller in diameter than the bit diameter.

19. A well drilling assembly comprising a bit having a passage therethrough, a predetermined outer diameter less than $6\frac{3}{4}''$ to drill a hole of the predetermined size less than $6\frac{3}{4}''$ diameter and an upper end;

a bottom hole assembly having a passage therethrough communicating with the bit passage and including a first lowermost stabilizer having a lower end coupled to the bit upper end, a crown having an outer diameter 0.003–0.025 inches smaller than the bit diameter and a plurality of flutes, and an upper end;

a first spacer conduit having an outer diameter $\frac{7}{8}$–$1\frac{1}{4}''$ smaller than the bit diameter connected to the upper end of the lower stabilizer;

a second stabilizer having a lower end connected to the conduit, a crown having an outer diameter 0.003–0.025 inches smaller than the bit diameter and a plurality of flutes and an upper end;

a first fishing neck connected to the upper end of the upper stabilizer;

a third stabilizer having a lower end connected to the first fishing neck, a crown having an outer diameter 0.003–0.025 inches smaller than the bit diameter and a plurality of flutes and an upper end;

a second spacer conduit having an outer diameter $\frac{7}{8}$–$1\frac{1}{4}''$ smaller than the bit diameter connected to the upper end of the third stabilizer;

a fourth stabilizer having a lower end connected to the second spacer conduit, a crown having an outer diameter 0.003–0.025 inches smaller than the bit diameter and a plurality of flutes and an upper end;

a second fishing neck connected to the upper end of the fourth stabilizer;

a spacer joint having an outer diameter $\frac{7}{8}$–$1\frac{1}{4}''$ smaller than the bit diameter, a lower end connected to the upper end of the second fishing neck and an upper end; and a fifth stabilizer having a lower end coupled to the spacer joint upper end, a crown having an outer diameter 0.003–0.025 inches smaller than the bit diameter and a plurality of flutes, and an upper end.

20. The well drilling assembly of claim 19 wherein the stabilizers are 0.005–0.010 inches smaller in diameter than the bit diameter.

* * * * *